United States Patent [19]

Barkow

[11] 3,996,542

[45] Dec. 7, 1976

[54] DEFLECTION YOKE HAVING NONRADIAL WINDING DISTRIBUTION

[75] Inventor: William Henry Barkow, Pennsauken, N.J.

[73] Assignee: RCA Corporation, New York, N.Y.

[22] Filed: Apr. 14, 1975

[21] Appl. No.: 567,967

[52] U.S. Cl. ..... 335/213; 335/210

[51] Int. Cl.[2] ..... H01F 7/00

[58] Field of Search ..... 335/210, 213

[56] References Cited

UNITED STATES PATENTS

| | | | |
|---|---|---|---|
| 3,601,731 | 8/1971 | Christiana et al. | 335/213 X |
| 3,757,262 | 9/1973 | Over et al. | 335/213 |
| 3,758,888 | 9/1973 | Kadota | 335/213 |
| 3,895,329 | 7/1975 | Logan et al. | 335/213 X |

*Primary Examiner*—George Harris

*Attorney, Agent, or Firm*—Eugene M. Whitacre; Paul J. Rasmussen

[57] ABSTRACT

A deflection yoke includes a flared core, a first grooved ring member disposed at the front larger diameter portion of the core and a second grooved ring member disposed at the rear smaller diameter portion of the core and extending toward the front along the inside portion of the core with the grooves also extending inwardly and lying in radial planes with respect to the central longitudinal axis of the core. Conductor turns extending from the rear to the front of the core along the inside surface are retained by the grooves at the rear portion of the core to extend radially for the length of the rear grooves and to extend nonradially from the inside end of the rear grooves to the retaining grooves in the front ring member.

5 Claims, 2 Drawing Figures

DEFLECTION YOKE HAVING NONRADIAL WINDING DISTRIBUTION

BACKGROUND OF THE INVENTION

This invention relates to precision deflection yokes having conductor turns thereof disposed in a nonradial manner relative to the central longitudinal axis of the yoke.

It is recognized that as multi-beam color television picture tubes are utilized which have increasingly wider deflection angles, the effects of the deflection yoke on beam and raster distortion become greater. This situation exists for both in-line and delta configurations of the electron gun structure within the picture tubes. Because the characteristics of a deflection yoke can do much to upset a desired convergence condition of the beams or distort the scanned raster on the viewing screen of the picture tube, it has been recognized in the prior art that these characteristics also may be controlled such that the deflection yoke itself is utilized to aid the convergence of the beams and the formation of a satisfactory raster. Toroidally wound coils have been developed which have great precision in the placement of each conductor by the utilization of grooved rings at the front and rear end portions to hold the conductors in place. Each of these conductors lies in a plane determined by the grooves which hold the conductor at the front and rear end portions of the yoke. By suitably spacing, layering and interleaving the conductors, a yoke which has good repeatability in production and which provides satisfactory performance can be built. However, it has been necessary in most instances to utilize additional convergence and raster correction apparatus even with these precision toroids. What is desired is a precision wound deflection yoke which gives the yoke designer a greater degree of freedom in designing a yoke which results in the elimination of or reduction in the amount of convergence or raster correction apparatus required to be utilized in conjunction with the yoke.

SUMMARY OF THE INVENTION

A deflection yoke includes a flared core, a first grooved ring member disposed at the front larger diameter portion of the core and a second grooved ring member disposed at the rear smaller diameter portion of the core and extending toward the front along the inside portion of the core with the grooves also extending inwardly and lying in radial planes with respect to the central longitudinal axis of the core. Conductor turns extending from the rear to the front of the core along the inside surface are retained by the grooves at the rear portion of the core to extend radially for the length of the rear grooves and to extend nonradially from the inside end of the rear grooves to the retaining grooves in the front ring member.

Figure 1:
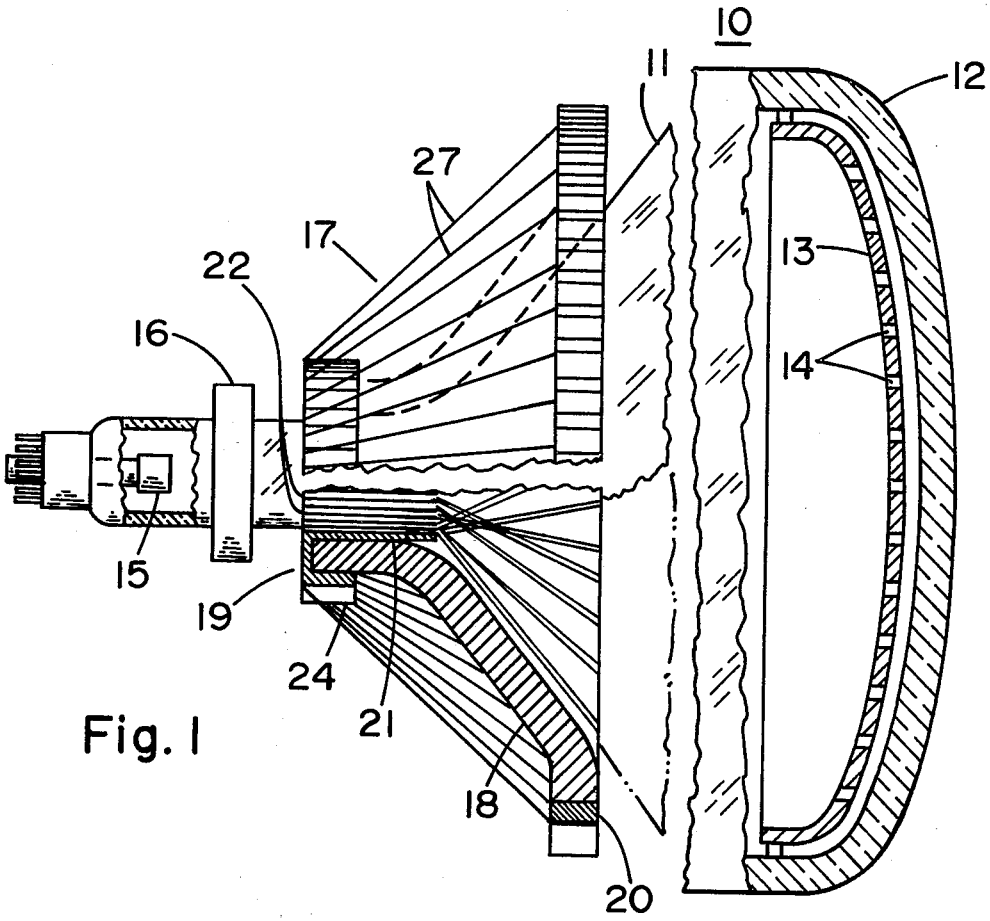
Figure 2:
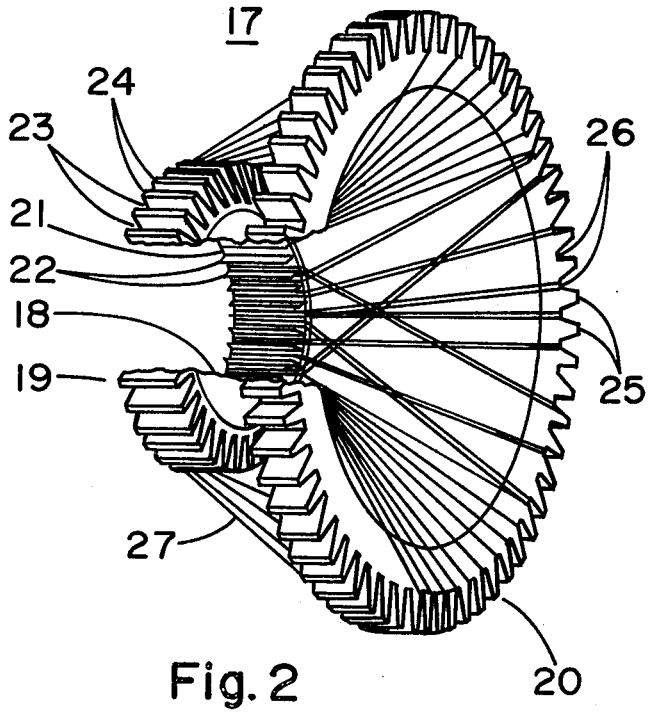

A more detailed description of the invention is given in the following description and accompanying drawing of which:

FIG. 1 is a partial cutaway view of a deflection yoke embodying the invention mounted on a television picture tube; and FIG. 2 is a partial cutaway perspective view of the deflection yoke of FIG. 1.

DESCRIPTION OF THE INVENTION

In FIG. 1 a color television picture tube 10 includes a glass envelope 11 and a glass faceplate portion 12 at the front portion thereof. Disposed inside the envelope and relatively closely spaced from faceplate 12 is an aperture mask 13 containing a plurality of apertures 14 through which electron beams pass to strike different colored phosphor elements, not shown, deposited on the inside of faceplate 12. At the other end of picture tube 10, the glass envelope 11 forms a cylindrical neck portion which contains an electron gun assembly 15. Mounted forward of gun assembly 15 around the neck portion of the tube is a convergence and purity assembly 16. Assembly 16 may include conventional static or dynamic convergence magnet assemblies, as required, and conventional purity rings. Mounted forward of assembly 16 around the neck of picture tube 10 and near the flared portion of the envelope is a deflection yoke 17. Yoke 17 includes a flared ferrite core 18 which includes a cylindrical portion at its rear or small diameter end and an outwardly flared portion at its forward or large diameter end. Disposed around the large diameter end of core 18 is a first grooved ring member 20, the grooves of which serve to fixedly retain conductor turns 27 wound therein. At the small diameter portion of yoke 17 is a second grooved ring member 19 which includes a flange portion 21 extending longitudinally inwardly adjacent to the ferrite core 18 and fitting around the neck portion of tube envelope 11. Second ring member 19 contains a plurality of tabs 24 extending circumferentially around ring member 19 and forming grooves 23 therebetween for fixedly retaining conductor turns at the rear of yoke 17.

As used herein, the term "radial" groove or conductor turn refers to a groove or conductor turn which would lie in a plane including the central longitudinal axis of the ferrite core and "nonradial" refers to a groove or conductor turn no lying in such a plane.

The inside flange 21 of rear ring 19 contains a plurality of radially extending tabs 22 forming grooves therebetween. As illustrated in FIG. 1, the flange member 21 with its radial grooves extends longitudinally through the yoke for a distance approximately between one-third and one-half the longitudinal distance of the yoke. Although not illustrated, it is to be understood that flange member 21 with its radial grooves may also flare outwardly to extend forward for a greater distance along the flared inside surface portion of core 18 if desired.

The conductor turns 27 retained in the grooves formed at the front and rear ring members 20 and 19 may be toroidally wound as indicated by the return conductor portions of conductor 27 extending from the front to the rear of the yoke on the outside portion of the yoke.

The conductor turns at the front portion of the deflection yoke may be interleaved if desired so that conductor turns making up the vertical and horizontal deflection coil portions are distributed in a desired pattern with one another. Such distribution of conductors can in a known manner control the astigmatism characteristics of the deflection yoke to effect self-convergence of the beams particularly in the case in which the electron gun structure 15 of picture tube 10 contains three horizontal in-line beams. It is known that a conductor turn distribution which provides a generally pincushion shaped horizontal deflection field and a barrel shaped vertical deflection field can be utilized to achieve substantial convergence of the three beams at all portions of the scanned raster without the use of any dynamic convergence apparatus. Similarly, in wider deflection angle picture tubes utilizing deflection angles of 110° or more, the above described deflection fields can be utilized with a simplified dynamic convergence arrangement to provide convergence of the beams over the raster. Simplified convergence as used herein refers to an arrangement whereby dynamic convergence at only one of the line and field scanning rates is utilized. Such arrangements provide for reduced complexity and cost in the convergence circuits of a television receiver.

Further in accordance with the invention, it has been determined that in addition to the nonradial disposition of conductor turns 27 at the front portion of yoke 17 additional advantages may be obtained by utilizing radially disposed conductor turns at the rear portion of the deflection yoke as illustrated in FIGS. 1 and 2. These radial turns can be selected in number and interleaved in the vertical and horizontal coil portions to control the coma characteristics of the deflection yoke. Particularly in the situation in which the deflection yoke is utilized with a picture tube providing three in-line beams the self-converging characteristics of the yoke as described above may result in an undesirable coma condition. In the past, such a coma condition characterized by the raster of the middle beam being different in size from the rasters of the two outside beams has been corrected by utilizing magnetic shunts and enhancers around the outside beams or the inside beam, respectively. Alternatively, coma could be corrected by utilizing structure which is dynamically energized. Both of these approaches may be either costly or not completely satisfactory, particularly with picture tubes utilizing the 110° or greater deflection angle. A feature of the present invention is to correct the coma condition existing in a deflection yoke by the use of the radially disposed conductors extending along the radial grooves of rear ring 19.

It is noted that the provision of the radial grooves in rear ring member 19 in conjunction with the grooves in front ring member 20 provide a three point control of each conductor turn, the first point being the start of the radial wire at the rear of the yoke which then extends for a given distance axially inward, the second point being the exit of the conductor turn from the radial groove and the third point being the particular groove on the front ring member which determines the amount of nonradial angular disposition of the conductor turn. These features according to the invention provide a greater degree of freedom than has heretofore existed in deflection yokes utilizing only two point anchoring of each conductor turn at the rear and front portions of the yoke. With the present arrangement it is possible to wind a yoke providing for more control of the beam and raster characteristics of the yoke than has heretofore been possible. As illustrated most clearly in FIG. 2, not all of the conductor turns need be nonradially disposed. The particular number and angular deviation of the turns would be determined during design of the yoke when the dimensions and requirements of a particular picture tube and ferrite core have been selected.

Use of nonradial turns only in the large flared portion of the yoke minimizes the adverse effect of loss of packing density in deflection sensitivity because the distance between the outside neck diameter of the picture tube and the inside diameter at the small end of the core is minimized.

What is claimed is:

1. A deflection yoke comprising:

a core including an outwardly flared inside surface portion;

a first set of grooves disposed at the front larger diameter portion of the core;

a second set of grooves disposed at the rear smaller diameter portion of the core and extending toward said front along the inside surface portion of said core, said second set of grooves also extending inwardly along said inside surface and lying in radial planes with respect to the central longitudinal axis of the core; and conductor turns extending from said rear to said front of said core along said inside surface and retained by said grooves at said rear portion of said core to extend nonradially from the inside end of said second set of grooves to the first set of grooves.

2. A deflection yoke according to claim 1 wherein conductor turns are toroidally wound on said core.

3. A deflection yoke according to claim 2 wherein said radial second set of grooves extends at least a third but less than one-half of the central longitudinal dimension of said core.

4. A deflection yoke according to claim 2 wherein said radial second set of grooves extends substantially only along a non-flared cylindrical inside surface portion of the core.

5. A deflection yoke according to claim 2 wherein conductors forming horizontal and vertical deflection coils are interleaved with each other in said radial second set of grooves for controlling primarily the coma characteristics of said coils and the number of conductor turns and the angular departure of said turns extending from the end of said second set of grooves to said first set of grooves are selected for controlling primarily the astigmatism characteristics of said coils.

* * * * *